United States Patent [19]

Pauls et al.

[11] Patent Number: 4,651,899

[45] Date of Patent: Mar. 24, 1987

[54] CONTAINER, PARTICULARLY A PRESSURE CAN FOR DISCHARGING SINGLE OR MULTIPLE COMPONENT SUBSTANCES

[75] Inventors: Matthias Pauls, Haltern, Fed. Rep. of Germany; Lothar Miczka, Altstätten, Switzerland

[73] Assignee: Lothak Miczka, Alstätten, Switzerland

[21] Appl. No.: 706,850

[22] PCT Filed: Jun. 19, 1984

[86] PCT No.: PCT/CH84/00100

§ 371 Date: Feb. 12, 1985

§ 102(e) Date: Feb. 12, 1985

[87] PCT Pub. No.: WO85/00157

PCT Pub. Date: Jan. 17, 1985

[30] Foreign Application Priority Data

Jun. 24, 1983 [DE] Fed. Rep. of Germany ..... 3322811

[51] Int. Cl.[4] ..... B65D 83/14

[52] U.S. Cl. ..... 222/130; 222/402.1; 222/402.21; 215/DIG. 8

[58] Field of Search ..... 222/130, 190, 402.1, 222/80, 402.21, 402.22, 402.23, 402.25, 129, 145; 206/219, 221, 222; 604/410; 215/DIG. 8

[56] References Cited

U.S. PATENT DOCUMENTS

| | | | |
|---|---|---|---|
| 2,786,769 | 3/1957 | Greenspan | 215/DIG. 8 X |
| 3,137,414 | 6/1964 | Steinkamp | 222/402.24 X |
| 3,318,484 | 5/1967 | Modderno | 222/402.1 X |

FOREIGN PATENT DOCUMENTS

| | | |
|---|---|---|
| 0042128 | 6/1981 | European Pat. Off. . |
| WO 84/01355 | 4/1984 | World Int Prop. O. . |

*Primary Examiner*—Joseph J. Rona
*Assistant Examiner*—Jay I. Alexander
*Attorney, Agent, or Firm*—Helfgott & Karas

[57] ABSTRACT

An additional container (29) for receiving further components is arranged in the container (21) for discharging preferably polyurethane foam. The additional container (29) receives a rod (37) cooperating with an inner cover (45) sealed in said container (29). The rod is led to the outside through a packing (31) in an additional container connection connected to the bottom (20) of container (21) and is movable into container (21) for blowing off cover (45). A disk (24) inserted in a recess of container bottom (20) and fixed by its beaded edge secures a sleeve (31) penetrated by the rod (37) constructed as an axially movable plunger. The outer and inner edges (39, 40) of sleeve (31) bring about a sealing action on in each case one radial collar (38, 39) of the plunger when rod (37) is inserted, and resiliently gives way during the axial movement of the plunger.

6 Claims, 1 Drawing Figure

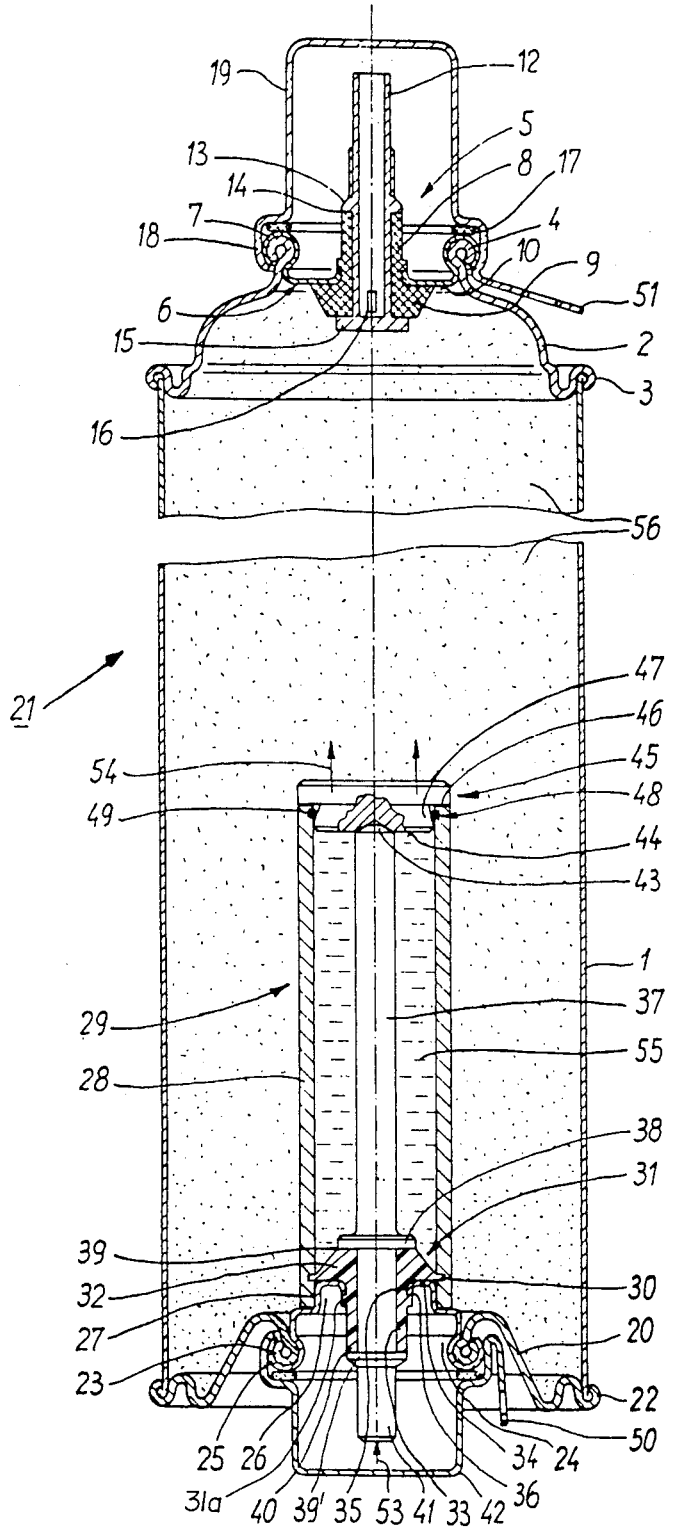
19
12
5
13
8
17
14
7
4
18
10
9
51
6
15
2
3
16
56
21
47
46
54
45
48
49
44
43
1
29
37
55
28
38
31
39
30
32
27
20
23
22
50
25
26
34
24
31a
40
39'
35
53
41
33
42
36

CONTAINER, PARTICULARLY A PRESSURE CAN FOR DISCHARGING SINGLE OR MULTIPLE COMPONENT SUBSTANCES

The present invention relates to a container, particularly a pressure can for discharging single or multiple component substances, preferably polyurethane foam, with an additional container receiving further components and which receives a rod cooperating with an internal cover sealed in the additional container, said rod being led to the outside through a packing in an additional container connection connected to the container bottom and is movable into the container for blowing off the cover of the additional container.

The invention more particularly relates to the construction of pressure cans or containers which, apart from the liquid substances of the main component necessary for producing and discharging the polyurethane foam, also receive an additional container connected to the container constituted by the pressure can and which contains the further components. The substances contained in the pressure can are generally liquid and normally comprise a prepolymer, optionally a foaming agent and the liquid pressure gas used for discharging the foam. The further components are present in a relatively small quantity and generally comprise a hydroxy compound with hydroxyl groups, which accelerate the curing or hardening of the foam, so that it only has to take a fraction of the moisture necessary for hardening from the outside air. The further components are introduced into the container through the blowing off of the cover shortly prior to the discharge of the foam and after opening the additional container, through its content being poured into the pressure can. The poured-in components bring about a chemical reaction, preferably a polyurethane reaction, so that a rapidly hardening foam is obtained on discharge from the can.

The invention is based on a known container (German Utility Model No. 82 27 229.8 and international application No. WO84/01355). The pressure can known therefrom has a one-part bottom obtained by shaping a metal blank. The neck of an additional container provided with an external thread is inserted in a recess in said bottom and, with the aid of a nut screwed on from the outside and accompanied by the deformation of a U-ring packing, is braced between a shoulder of the additional container and the inner edge of the bottom recess. The rod led to the outside and sealed by a plungerlike packing within the additional container is constructed as a shaft, which rotates in the additional container neck and is internally supported thereon. If the shaft is driven from the outside, this brings about the positive engagement of its inner end with the additional container cover, which is consequently blown off counter to the internal pressure in the can.

Admittedly pressure containers or cans with a shaped bottom are used to a considerable extent, but the bottom is in such cases not recessed. However, if the bottom has to be provided with an insert in the manner of the additional container according to the prior art, it proves to be unpractical, because it brings about the described bracing with the aid of a nut and a U-ring packing. This requires unacceptable technical effort and expenditure and a corresponding complicated assembly. As a result of the need to blow off the cover against the relatively large internal pressure of the can, the rotary mobility of the rod, i.e. its shaft-like construction leads to the relatively complicated sealing and cover construction. Thus, the expenditure for the advantage of faster hardening of the polyurethane foam is unacceptably high.

The problem of the invention is to simply construct a container of the aforementioned type in such a way that the parts can be more easily fitted to form an undetachable unit, but can be operated with adequate force applied by the user for the blowing off of the additional container cover.

According to the invention this problem is solved in that a disk inserted in a recess in the container bottom and fixed by its beaded edge holds a sleeve penetrated by a rod constructed as an axially movable plunger, the outer and inner edges of said sleeve being sealed in each case on one radial collar of the plunger when the latter is inserted and resiliently gives way during the axial movement of the plunger.

The beading of the disk edge is simple and leads to an adequate sealing of the disk in the bottom, particularly of a pressure can, so that the additional container can be fitted with limited effort and expenditure and the aerosol container is reliably sealed relative to the outside. The plunger construction of the rod reduces to a considerable extent the sealing problem of the additional container, the internal pressure being applied via the dome to the plunger and from the latter via the inner plunger collar to the sleeve rim and the container. In order to blow off the additional container cover, the elastically resilient sleeve with the outer collar of the plunger is deformed without losing its sealing action, which is brought about by the pressure applied from the outer rim of the sleeve. The forces to be applied are of a substantially random nature, because the user can press the can with the outwardly projecting end of the plunger on to a firm substrate, e.g. a table top.

The invention has the advantage that it realizes and makes possible the simple assembly procedure of beading. Thus, the expenditure for assembly is reduced and simple construction of the described parts is possible and they also operate in an absolutely reliable manner.

The details, further features and other advantages of the invention can be gathered from the following description relative to the drawing, which shows in axial longitudinal section a pressure can or container according to the invention.

The actual pressure container 21 comprises a cylindrical tube 1, which is closed at one end by a dome 2. This has a beaded edge 3, which secures the dome 2 on the particular end of container 1 and simultaneously brings about a tight connection of the parts. Dome 2 is produced from a circular plate, a blank cut from sheet metal and given the curved shape shown in the drawing by a shaping process. The inner edge or rim of dome 2 is indicated at 4, is beaded and receives a valve disk 6 with a disk valve 5. Valve disk 6 is in turn beaded with its edge 7 around the edge 4 of dome 2 and is consequently sealed with respect thereto. It holds a rubber plug 8, which is in turn supported by a flangelike, widened portion 9 on the underside 10 of valve disk 6 and is penetrated by a hollow valve rod 12. This rod has an outer collar 13, which is supported on the outer edge 14 of plug 8. The tubular portion of the valve is terminated by a disk 15, above which there are one or more openings 16. A sheet gasket 17 is braced by the edge 18 of cover 19 overlapping the beading 4 and ensures that no atmospheric humidity can penetrate from the outside.

The bottom 20 of pressure can 21 is located at the opposite end. It corresponds to a concavely, inwardly folded dome 20, there being sufficient material in its stabilizing folds so that, if excessive pressure is produced, e.g. at temperatures over 50° C., it can be reversed over to the outside and consequently provides an additional safety space by increasing the volume of the complete container. However, all parts of bottom 20 corresponds to dome 2 with the exception of the inward curvature, so that there is no need to provide a detailed description thereof. It is consequently secured with a beaded edge 22 on the particular end of tube 1, the edge surrounding the central recess being beaded, as indicated at 23. A disk 24 is fixed to said edge by beading 25. The disk has an axially inwardly extending portion 26 defining an annular recess the outer edge of which has a diameter such that it can only be inserted in the outer end of a tube 28 under tension, i.e., it must be press-fitted into tube 28 which forms the casing of an additional container 29. An annular groove 30 in the inner surface of tube 28 is used for the positive connection of tube 28 to an inner collar 32 of an elastic sleeve 31. Collar 32 abuts the shoulder 34 of inwardly extending portion 26, whilst the connecting cylindrical portion 33 of sleeve 31 is held by the inner edge 35 of annular space 36. The axial locking towards the inside is ensured by positive engagement at 36 between the inner edge 35 of portion 26 and an annular rib 31*a* on sleeve 31.

A rod, constructed as plunger 37 is inserted in tube 28, concentrically thereto. It has an inner collar 38, with which it is supported on the inner edge 39 of sleeve 31 and also has an outer collar 39', which can be correspondingly supported on the outer edge 40 of sleeve 31. The projecting plunger end 41 is covered with a cap 42 like cap 19.

The inner end 43 of plunger 37 is supported on the inside 44 of an additional container cover 45. The latter is located with a circular shoulder 46 abutting against the inner end face of tube 28, and extends with its smaller diameter portion 47 into the interior of tube 28. A ring packing 48 inserted in an inner groove 49 of tube 28 provides the sealing relative to this portion.

In situ, the user firstly removes cap 42. This is relatively simple, because he only has to pull on tongue 50, which forms a subassembly with cap 42, so that its edge is deformed and is drawn off the heading 23. After actuating the tongue 51 of cap 19 in the corresponding manner, the user strikes pressure can 21 by end 41 of plunger 37 against a solid or form substrate. This initiates the axial movement of plunger 37 indicated by arrow 53 leading to the resilient giving way thereof, due to the fact that the outer collar 39' is supported on the outer rim 40 of sleeve 31. Thus, the inner end 43 of plunger 37 is nonpositively engaged with the additional container cover 45, so that the latter is blown off into the interior of pressure can 21, in accordance with arrows 54. The consequently released content 55 of additional container 29 in the interior of pressure can 21 passes by shaking into the content 56 of container 21. This content consists of the aforementioned further components.

After the liquid components have been intimately mixed in the aforementioned manner, the container content can be discharged by tilting valve 12. The disk 15 is thereby raised from collar 9, so that opening 16 is freed and the container content can flow to the outside through the valve tube.

What is claimed is:

1. A pressure can containing constituents for forming and dispensing polyurethane foam comprising an outer container having a first end with a dispensing valve and a second end having a central opening;

an inner container within said outer container, said inner container including a generally tubular body, a disk having a beaded attachment to said central opening in said second end of said outer container, said disk having a central hole and means surrounding said central hole for firmly engaging and supporting one end of said tubular body, and a removable cover sealingly attached to the other end of said tubular body for isolating the interior volumes of said containers from each other until said removable cover is removed;

an elongated rod having axially spaced collars mounted thereon; and a resilient seal member of elastomeric material fixedly attached to said tubular body and extending through said central hole in said disk in sealing relationship therewith, said seal member surrounding said rod between and in sealing relationship with said collars and supporting said rod so that a first end of said rod rests adjacent an inner surface of said removable cover and a second end of said rod protrudes beyond said second end of said outer container, said seal member being sufficiently resilient to permit said rod to be moved axially as a plunger in response to sudden force applied to said second end of said rod so that said first end of said rod abuts and removes said removable cover from said tubular body while maintaining said sealing relationship with said collars, thereby permitting mixing of the contents of said inner and outer containers.

2. A container according to claim 1 wherein said second end of said outer container is concavely inwardly deformed.

3. A container according to claim 2 wherein said protruding end of said rod is covered by a cap removably attached to said beaded attachment of said disk.

4. A container according to claim 3, wherein said means surrounding said central hole for supporting one end of said tubular body includes an annular inward protrusion on said disk press-fitted into said one end of said body.

5. A container according to claim 4, wherein said resilient seal member includes a radially outwardly extending flange fixedly attached to an inner surface of said tubular body.

6. A container according to claim 5, wherein said removable cover includes a first portion having a face abutting the end face of said other end of said tubular body and a second portion integral with said first portion and extending into said other end of said tubular body, said body including a sealing ring surrounding and sealingly engaging said second portion.

* * * * *